US007789699B2

(12) United States Patent
Wang

(10) Patent No.: US 7,789,699 B2
(45) Date of Patent: Sep. 7, 2010

(54) FLEXIBLE PRINTED CIRCUIT CONNECTOR AND SLIDER

(75) Inventor: Hong-Fang Wang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/548,459

(22) Filed: Aug. 27, 2009

(65) Prior Publication Data

US 2010/0055940 A1 Mar. 4, 2010

(30) Foreign Application Priority Data

Aug. 27, 2008 (CN) ..... 2008 2 0041465 U

(51) Int. Cl.
*H01R 12/24* (2006.01)

(52) U.S. Cl. ..... 439/495

(58) Field of Classification Search ..... 439/495, 439/342, 496, 493, 632, 499, 492
See application file for complete search history.

(56) References Cited

U.S. PATENT DOCUMENTS 5,688,143 A 11/1997 McHugh et al.
6,561,843 B1 * 5/2003 Ma et al. ..... 439/495
7,374,451 B2 5/2008 Wei et al.
2005/0118861 A1 * 6/2005 Chung ..... 439/495
2006/0030206 A1 * 2/2006 Zhang et al. ..... 439/495
2007/0141897 A1 * 6/2007 Miura et al. ..... 439/495
2007/0249217 A1 * 10/2007 Shiu et al. ..... 439/495

* cited by examiner

*Primary Examiner*—Neil Abrams
*Assistant Examiner*—Phuong Nguyen
(74) *Attorney, Agent, or Firm*—Andrew C. Cheng; Wei Te Chung; Ming Chieh Chang

(57) ABSTRACT

An electrical connector includes an insulative housing (3), a plurality of terminals (4) retained in the housing and a slider (5) moveably assembled to the housing. The terminal (4) has a first arm (42) and a second arm (43) both protruding into a mating room (34) defined by the insulative housing. The slider defines an urging portion (52) for driving a flexible printed circuit board engaging with the terminals when the slider moving to a closed position from an opened position. The urging portion has a first contacting surface (521) and a second contacting surface (522) at same side thereof. The first contacting surface is located closer to the first arm than the second contacting surface at a vertical direction. The second arm is located below the first contacting surface at said opened position and engaging with the second contacting surface at said closed position.

20 Claims, 8 Drawing Sheets

FLEXIBLE PRINTED CIRCUIT CONNECTOR AND SLIDER

BACKGROUND OF THE INVENTION

1. Field of the Invention

The present invention relates to an FPC connector, and more particularly, to an FPC connector having moveable slider facilitating electrical interconnection between flexible printed circuit and FPC connector.

2. Description of the Related Art

U.S. Pat. No. 7,374,451 issued to Wei etc. on May 20, 2008, discloses a conventional electrical connector mounted on a Printed Circuit Board for engaging with a flexible printed circuit board (FPC). The conventional electrical connector includes a longitudinal insulative housing, a plurality of terminals retained in the housing across the connector, and a slider moving between an opened position and a closed position relative to the housing. The insulative housing has a mating space for receiving the FPC and a plurality of grooves in communicating with the mating space. Each of the terminals includes a contacting arm electrically connecting with the FPC and a retaining arm corresponding to the contacting arm, both of which extend towards the mating space. The slider defines an urging portion at middle thereof for urging the FPC against the contacting arm and a pair of latches attachable to the insulative housing at both ends thereof.

When the slider is at opened position, the urging portion retrieves from the mating space and will not provide a biasing force against the FPC inserted into the mating space. When the slider moves to the closed position, said urging portion goes into the mating space and to drive the FPC to displace upwards against the terminal. However, as the slider moves to the closed position from the opened position, an edge of the urging portion adjacent to the mating space may engage with the insulative housing and the terminal. So the slider could not be inserted into the mating space smoothly to achieve its intended purpose.

Therefore, an improved electrical connector is desired to overcome the disadvantages of the related arts.

SUMMARY OF THE INVENTION

An object of the present invention is to provide an electrical connector overcoming disadvantage of the slider inserted difficultly.

In order to achieve the above-mentioned object, an electrical connector in accordance with a preferred embodiment of the present invention includes an insulative housing, a plurality of terminals retained in the housing and a slider moveably assembled to the housing. The terminal has a first arm and a second arm both protruding into a mating room defined by the insulative housing. The slider defines an urging portion for driving a flexible printed circuit board electrically in contacting with the terminals when the slider moves to a closed position from an opened position. The urging portion has a first contacting surface and a second contacting surface. The first contacting surface is closer to the first arm than the second contacting surface at a vertical direction. The second arm is located below the first contacting surface at said opened position and engages with the second contacting surface at said closed position for preventing the slider from engaging with the insulative housing and the terminal.

Other objects, advantages and novel features of the invention will become more apparent from the following detailed description of the present embodiment when taken in conjunction with the accompanying drawings.

DETAILED DESCRIPTION OF THE INVENTION

Figure 1:
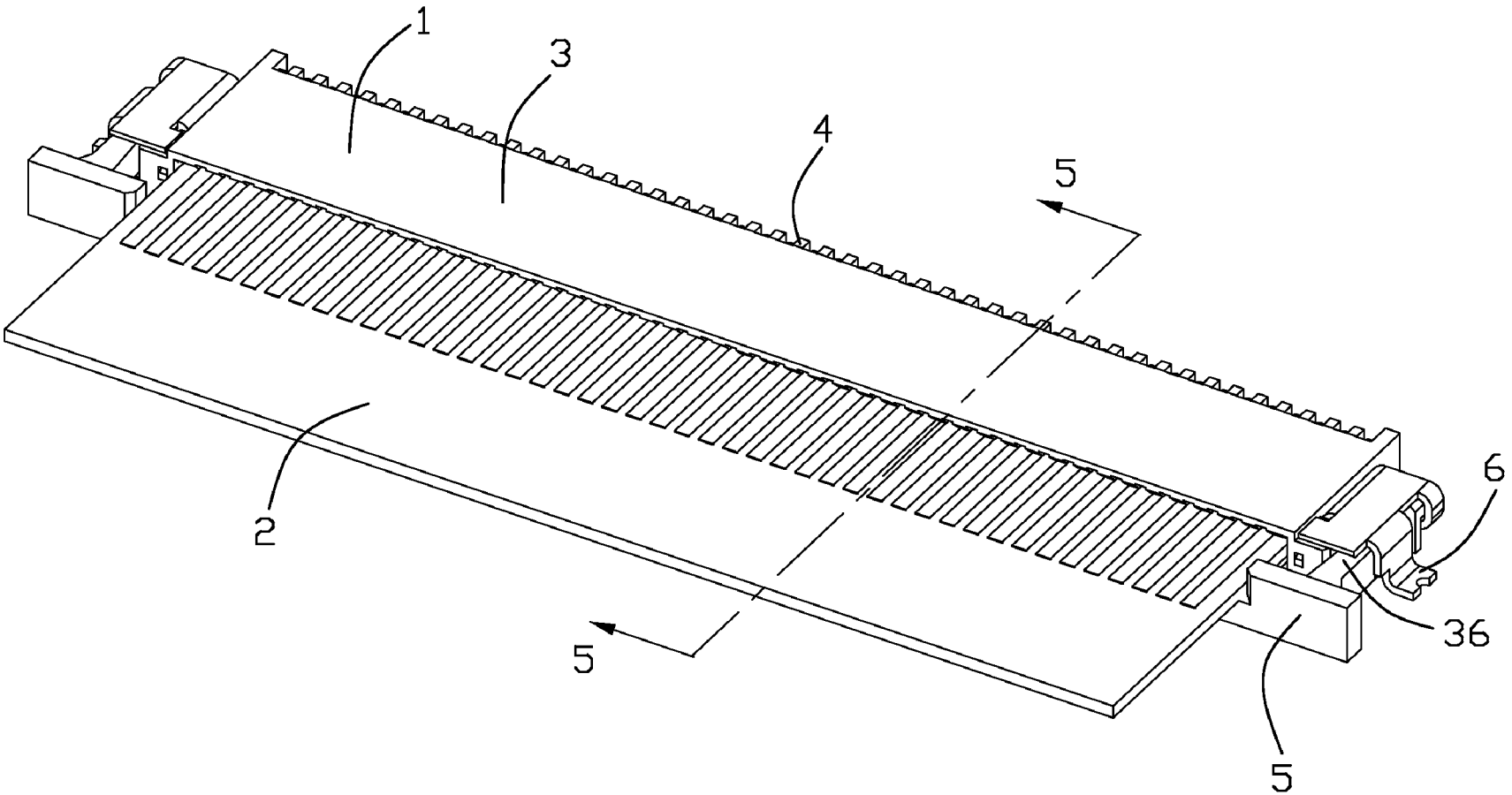
FIG. 1 is a perspective view of an FPC connector engaging with a flexible printed circuit board (FPC) in accordance with the preferred embodiment of the present invention.

Reference will now be made to the drawing figures to describe the preferred embodiment of the present invention in detail.

Figure 2:
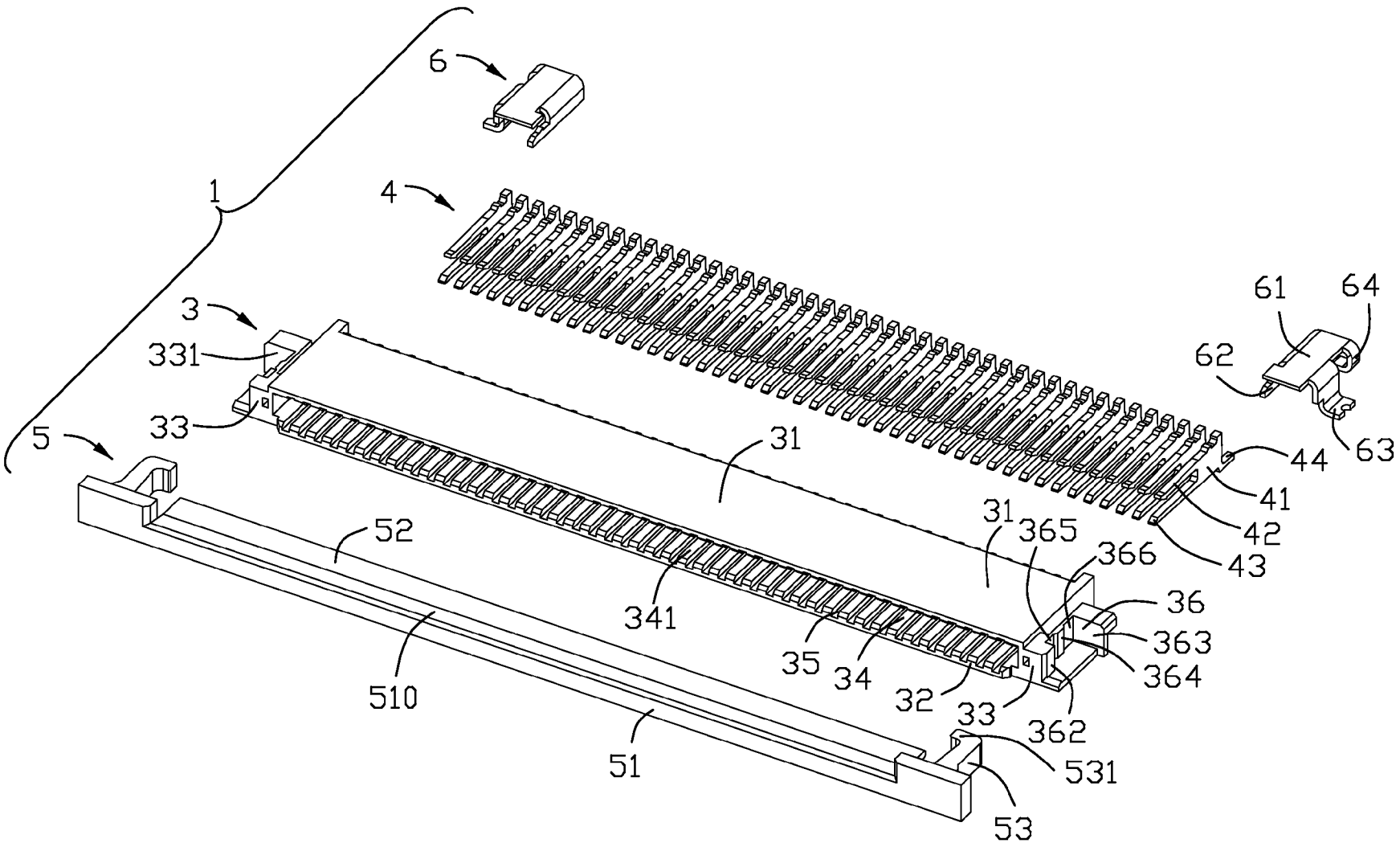
FIG. 2 is an exploded perspective view of the FPC connector of FIG. 1 but not showing the FPC.
Figure 3:
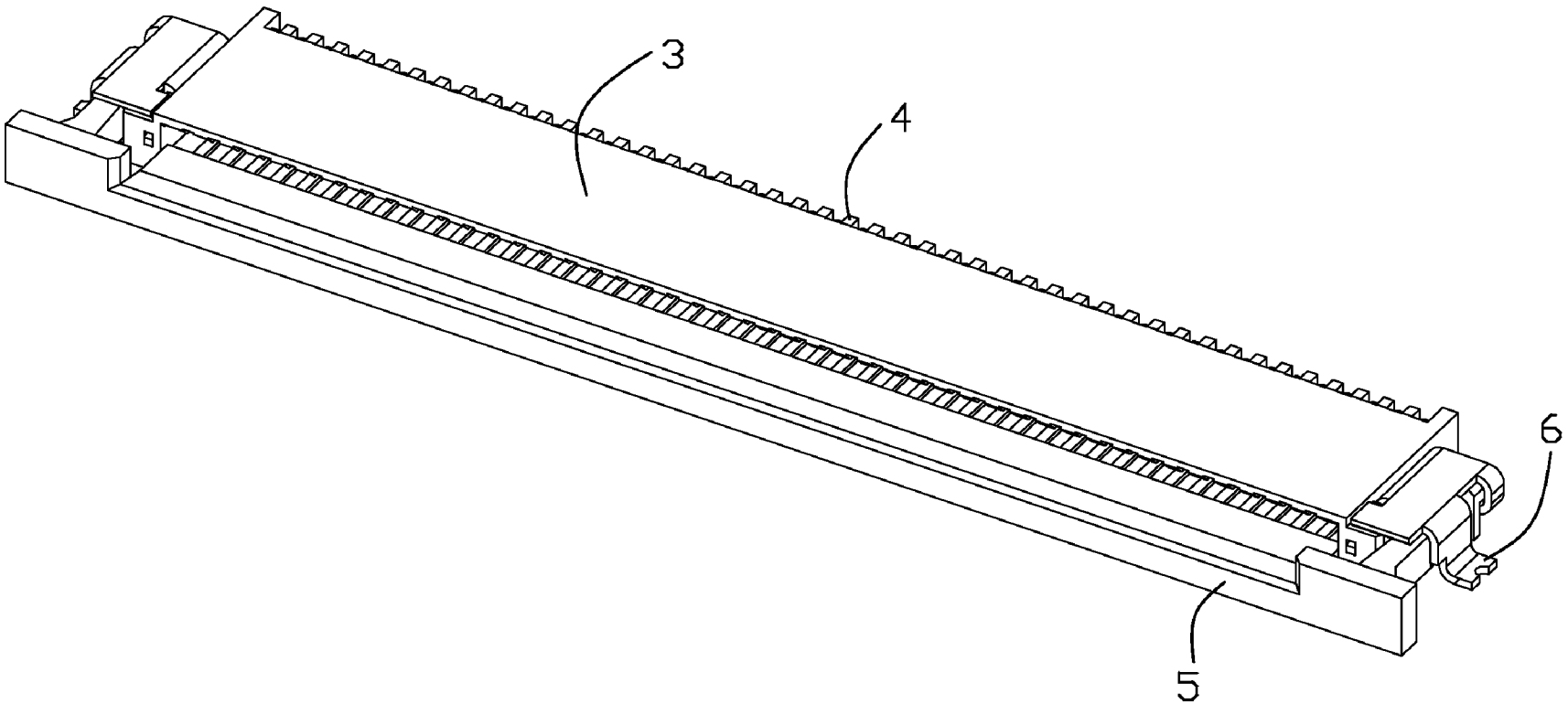
FIG. 3 is a perspective view of the electrical connector of FIG. 1.
Figure 4:
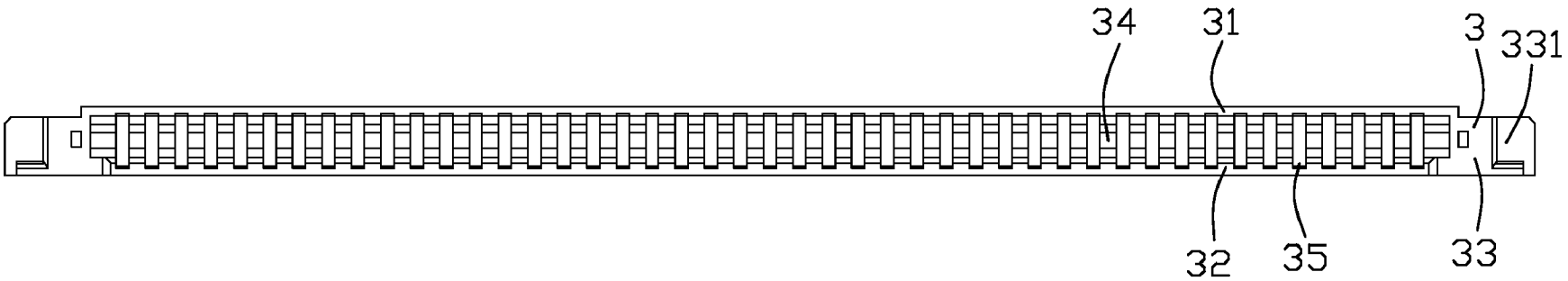
FIG. 4 is a front elevational view of the insulative housing of FIG. 2.

Referring to FIGS. 1 and 2, an electrical connector 1 for electrically connecting with a flexible printed circuit board (FPC) 2 in accordance with the present invention includes an insulative housing 3, a plurality of terminals 4 retained in the insulative housing across the electrical connector, and a slider 5 moveably assembled to the insulative housing and a pair of metallic ears 6 retained in both ends of the insulative housing.

Referring to FIG. 2 to FIG. 5, the insulative housing 3 has an upper side wall 31, an under side wall 32 and a pair of end walls 33 integrally joining said two side walls, thereby forming a longitudinal mating room 34 with an opening 341 at front thereof for receiving the FPC 2 therein. The side walls define a plurality of grooves 35 in communication with the mating room 34 for receiving the terminals 4. The grooves 35 include a plurality of top and bottom terminal slots arranged in the top and bottom walls, respectively and aligned with each other. The end wall 33 defines a recess 331 which forms a guiding slot 36 cooperating with the metallic ear 6 for respectively receiving a pair of latches of the slider.

The terminals 4 are arranged along a longitudinal direction. Each of the terminals is inserted frontward and has a retaining portion 41, an upper first arm 42 and an under second arm 43 extending from one end of the retaining portion, a soldering portion 44 extending from another end of the retaining portion. The first arm 42 and the second arm 43 both protrude into the mating room and slantways extend away from the insulative housing, thereby making said first and second arms being flexible to prevent the FPC sandwiched therebetween from being damaged. The second arm 43 is located closer to the opening 341 than the first arm to guide the slider being smoothly inserted into the mating room along the second arm.

The slider 5 includes a longitudinal body beam 51, an urging portion 52 extending from the body beam at middle thereof, and a pair of elastic latches 53 extending from the body beam at both ends thereof. The body beam 51 of the slider has a concave portion 510 at the middle thereof for receiving the FPC to prevent it from moving along the longitudinal direction.

Figure 5:
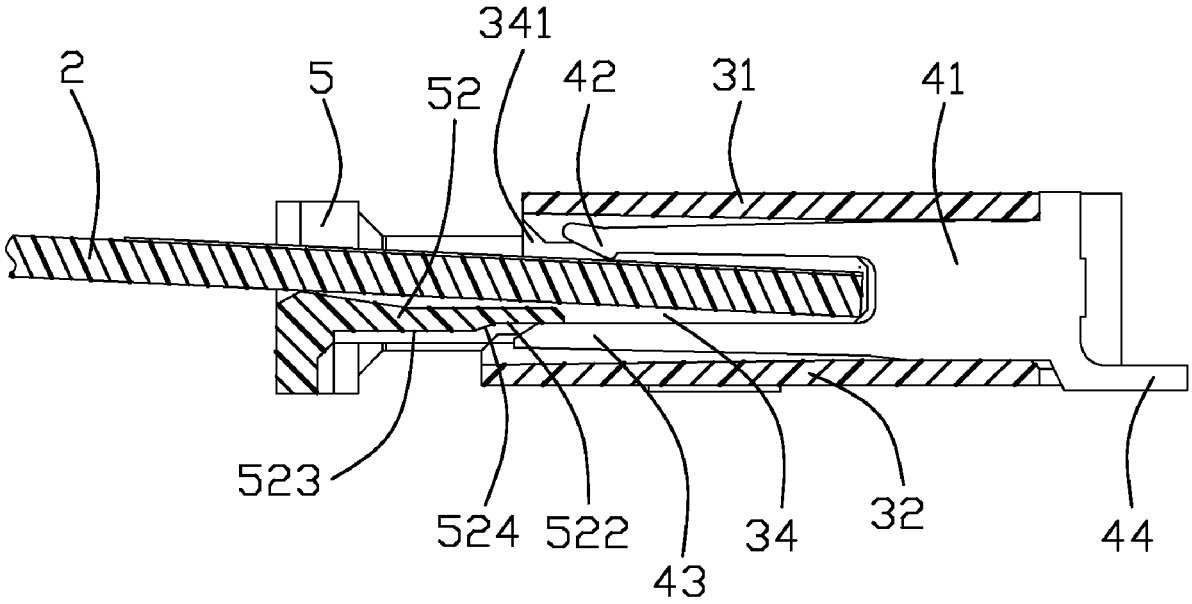
FIG. 5 is a cross-section view of the FPC connector with the FPC taken along line 5-5 of FIG. 1.
Figure 6:
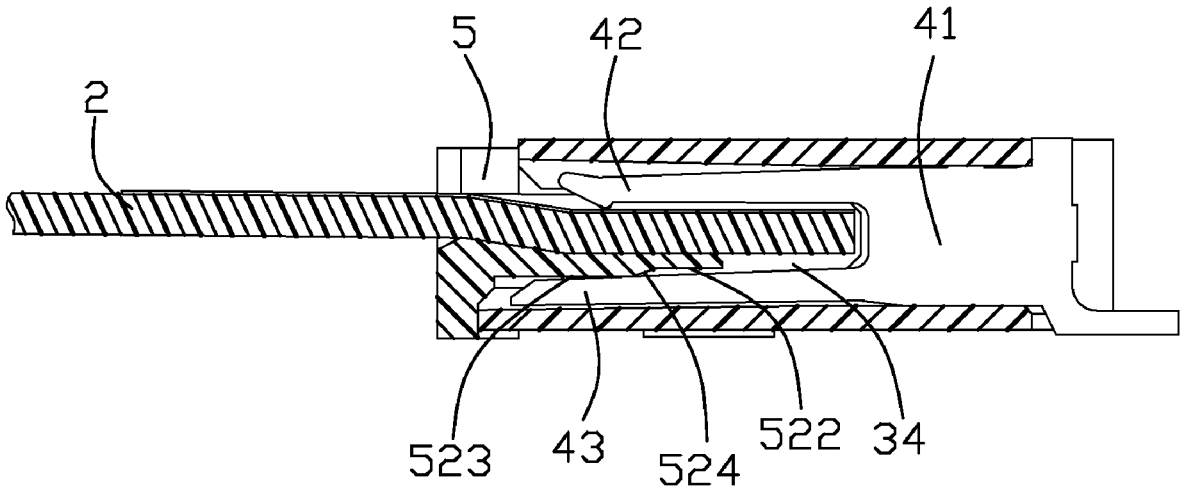
FIG. 6 is a cross-section view of the FPC connector with the FPC of FIG. 4 when the slider is at a closed position.
Figure 7:
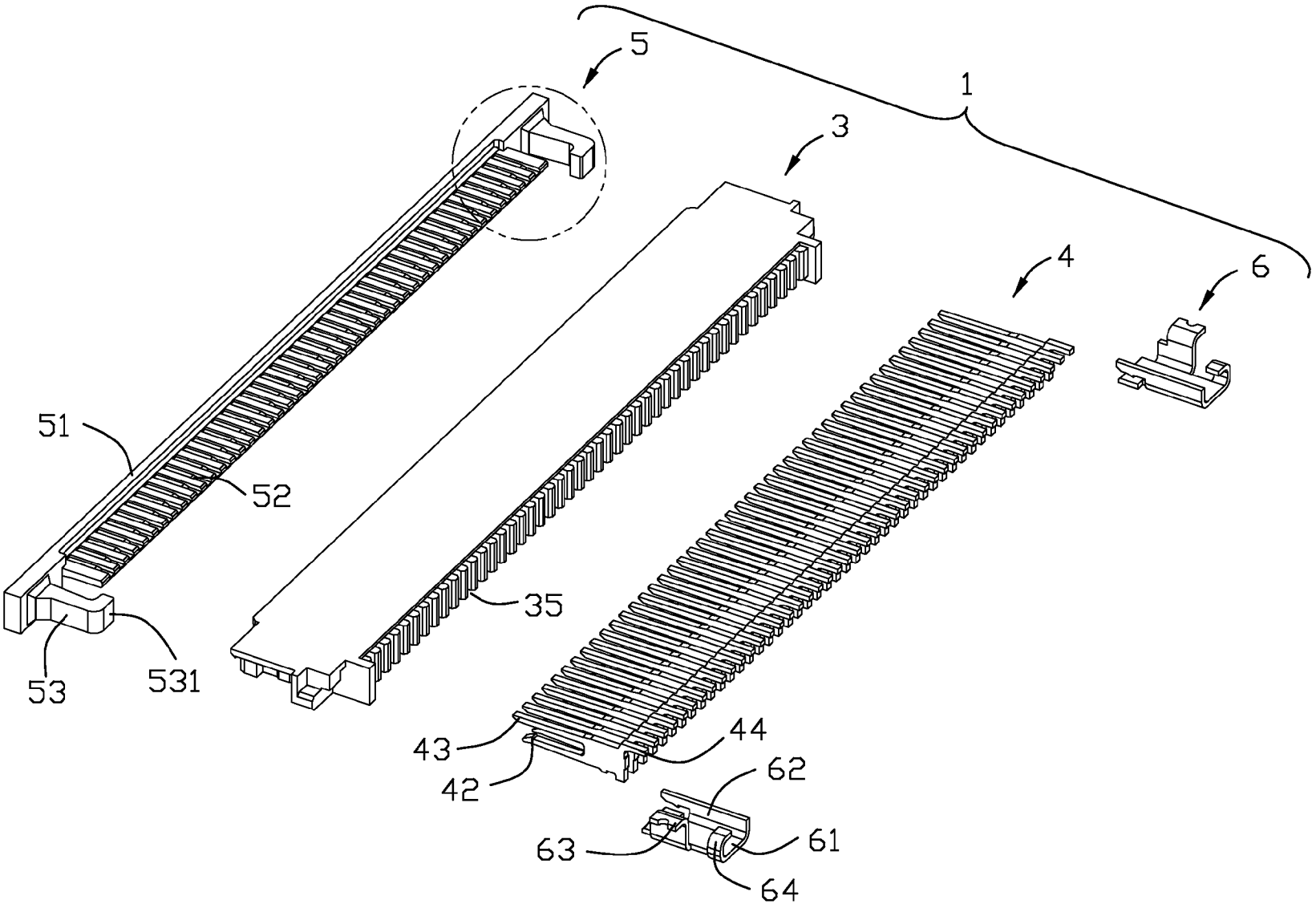
FIG. 7 is another exploded view of the FPC connector of FIG. 2.

Referring to FIGS. 5 and 6, the slider 5 moves between an opened position when the FPC 2 is permitted to insert into the mating room with zero-insertion force and a closed position when the urging portion 52 goes in the mating room and drive the FPC against the first arm 42 of the terminals. Referring to FIGS. 2 and 7, the metallic ears 6 has a body portion 61 covering on the recess 331 of the end wall, a retaining nail 62 extending from one side of the body portion and retained in the end wall, a solder tail 63 extending from another side of the body portion and coplanar with the soldering portion of the terminal and a fixing portion 64 at rear end thereof for preventing the metallic ear moving forward.

Referring to FIG. 2, the end wall 33 includes a front blocking portion 362, a rear blocking portion 363 and a middle blocking portion 364 between the two former blocking portions at a front-to-rear direction perpendicular to the longitudinal direction. And the middle blocking portion 364 extend towards the guiding slot 36 along the longitudinal direction, thereby dividing the guiding slot 36 into a front concaving slot 365 and a rear concaving slot 366. The latch 53 of the slider 5 comprises a hook 531 at the free end thereof received in the front concaving slot at the opened position. Then the hook 531 blocks in the rear concaving slot when the slider 5 moves to the closed position from the opened position. The middle blocking portion 364 defines two guiding inclined surface at two sides thereof for guiding the slider 5 moving along the front-to-rear direction.

Figure 8:
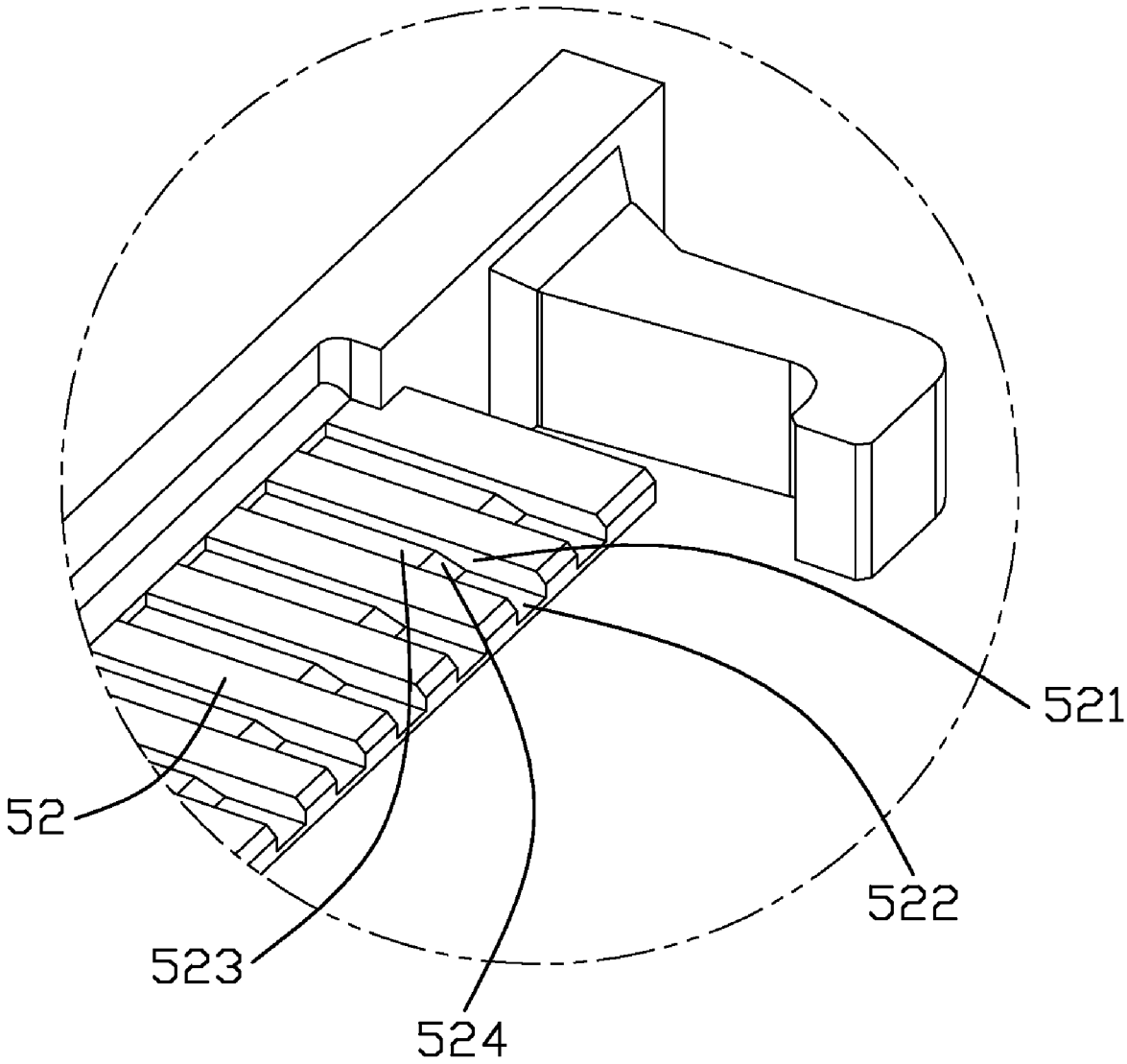
FIG. 8 is a partial enlarged view of the FPC connector of FIG. 6.

Referring to FIGS. 5, 6 and 8, the urging portion 52 of the slider 5 defines a plurality of recessed portion 521 at bottom side thereof for receiving the second arm 43. The inner surface of the recessed portion 521 is step-shaped which is formed by a first contacting surface 522, a second contacting surface 523 separated from each other and a guiding surface 524 as a transition area linking the two contacting surfaces together. The first contacting surface 522 is located higher and closer to the first arm 42 of the terminal than the second contacting surface 523 at a vertical direction perpendicular to the longitudinal direction.

The second arm 43 is always located below the first contacting surface and further engage with the latter at the opened position, thereby making the slider 5 be at a pre-assembled station for preventing the slider 5 from engaging with the insulative housing or the terminal. Further the slider 5 is located at a lower position, so that the inserting force of the FPC 2 is decreased. The second arm 43 moves along the guiding surface 524 to engage with the second contacting surface for making the urging portion 52 to move upwards and drive the FPC against the first arm 42 of the terminals tightly.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. An electrical connector for electrically connecting with a flexible printed circuit board (FPC) comprising:

an insulative housing comprising a pair of end walls integrally joining said two side walls, forming a longitudinal mating room with an opening at front for receiving the FPC therein; the side walls define a plurality of grooves in communication with the mating room for receiving a plurality of terminals; the grooves include a plurality of top and bottom terminal slots arranged in the top and bottom walls, respectively and aligned with each other; the end wall defines a recess which forms a guiding slot cooperating with a pair of metallic ears for respectively receiving a pair of latches of the slider;

the plurality of terminals retained in the insulative housing and comprising a first arm and a second arm both protruding into the mating room;

a slider moveably assembled to the insulative housing, comprising an urging portion received in the mating room for driving the flexible printed circuit board against with the terminals when the slider moving to a closed position from an opened position;

the slider includes a longitudinal body beam, an urging portion extending from the body beam at middle and a pair of elastic latches extending from the body beam at both ends; the body beam of the slider has a concave portion at the middle for receiving the FPC to prevent it from moving along the longitudinal direction;

the urging portion comprises a plurality of recessed portion, each formed with the first contacting surface, the second surface, the guiding surface and a rib being adjacent to the recessed portion;

wherein the urging portion of the slider comprise a first contacting surface and a second contacting surface both at same side thereof, the first contacting surface is located closer to the first arm of the terminal than the second contacting surface at a vertical direction, the second arm is located below the first contacting surface at said opened position and engaging with the second contacting surface at said closed position;

the pair of metallic ears, each having a body portion covering on the recess of the end wall, a retaining nail extending from one side of the body portion and retained in the end wall, a solder tail extending from another side of the body portion and coplanar with the soldering portion of the terminal and a fixing portion at rear end thereof for preventing the metallic ear moving forward.

2. The electrical connector as described in claim 1, wherein the second arm engages with the first contacting surface at the opened position.

3. The electrical connector as described in claim 1, wherein said actuator is moved in a vertical direction correspondingly when the actuator is moved between an open position where the first step engages with the biasing beam, and a closed position where the second step engages with the biasing beam, in a front-to-back direction.

4. The electrical connector as described in claim 1, wherein the insulative housing comprises a front blocking portion, a rear blocking portion and a middle blocking portion located between the front and rear blocking portions at a front-to-rear direction.

5. The electrical connector as described in claim 4, wherein the latch of the slider comprises a hook at the free end thereof received between the front blocking portion and the middle blocking portion at the opened position.

6. The electrical connector as described in claim 5, wherein the hook of the latch blocks between the middle blocking portion and the rear blocking portion at the closed position.

7. The electrical connector as described in claim 5, wherein the middle blocking portion defines two guiding inclined surface at two sides thereof.

8. The electrical connector as described in claim 2, wherein the terminals including contacting arms; each contacting arm electrically connecting with the FPC.

9. The electrical connector as described in claim 2, wherein the slider comprises a guiding surface linking the first contacting surface and the second surface together.

10. The electrical connector as described in claim 9, wherein the second arm is located closer to the opening than the first arm.

11. The electrical connector as described in claim 9, wherein the first and second arms slantways extend away from the insulative housing thereby making said first and second arms being flexible.

12. The electrical connector as described in claim 9, wherein the terminals retained in the insulative housing across the electrical connector.

13. The electrical connector as described in claim 12, wherein the second arm is received in the recessed portion correspondingly.

14. A flexible printed circuit (FPC) connector, comprising:

an insulative housing having a pair of end walls integrally joining a top wall and a bottom wall to define jointly a receiving space therebetween, and with a plurality of top and bottom terminal slots arranged in the top and bottom walls, respectively and aligned with each other;

a plurality of contact terminals inserted into the terminal slots and each contact having a contact engaging portion extending into the receiving space from the top terminal slot, and a biasing beam disposed in the bottom terminal slot adjacent to the bottom wall; and an actuator moveably assembled to the insulative housing, comprising an urging portion received in the mating room for driving the flexible printed circuit board against with a plurality of terminals when the actuator moving to a closed position from an opened position;

the actuator includes a longitudinal body beam, the urging portion extending from the body beam at middle and a pair of elastic latches extending from the body beam at both ends; the body beam of the actuator has a concave portion at the middle for receiving the FPC to prevent it from moving along the longitudinal direction the urging portion comprises a plurality of recessed portion, each formed with the first contacting surface, the second surface, the guiding surface and a rib being adjacent to the recessed portion;

the actuator received in the receiving space and having a driving surface facing the contact engaging portions, and an actuating surface with first and second steps; wherein when the first step engages with the biasing beam, the driving surface creates a first gap with respect to the contact engaging portion in a vertical direction perpendicular to an actuator insertion direction; when the second step engages with the biasing beam, the driving surface creates a second gap with respect to the contact engaging portion in said vertical direction, the second gap being smaller then the first gap;

the end wall defines a recess which forms a guiding slot cooperating with the metallic ear for respectively receiving a pair of latches of the slider; a pair of metallic ears, each having a body portion covering on the recess of the end wall, a retaining nail extending from one side of the body portion and retained in the end wall, a solder tail extending from another side of the body portion and coplanar with the soldering portion of the terminal and a fixing portion at rear end thereof for preventing the metallic ear moving forward.

15. The FPC connector as described in claim 14, wherein the first and second steps are separated from each other.

16. The FPC connector as described in claim 14, wherein the actuator comprises the guiding surface jointing the first and second steps together.

17. An interconnecting system, comprising: a flexible printed circuit (FPC) connector including an insulative housing configured a pair of end walls integrally joining at least by top and bottom walls, top and bottom terminal slots defined in the top and bottom walls respectively, a receiving space defined between the top and bottom walls;

a plurality of contact terminals received in the housing and each having a contact engaging portion extending into the receiving space, and a biasing beam disposed in the bottom terminal slot;

an flexible printed circuit cable having inserted into the receiving space and having a plurality of conductive traces facing and aligning with each of the contact engaging portion and a bottom surface; and an actuator moveably assembled to the insulative housing, comprising an urging portion received in the mating room for driving the flexible printed circuit board against with the terminals;

the actuator includes a longitudinal body beam, an urging portion extending from the body beam at middle and a pair of elastic latches extending from the body beam at both ends; the body beam of the actuator has a concave portion at the middle for receiving the FPC to prevent it from moving along the longitudinal direction;

the urging portion comprises a plurality of recessed portion, each formed with a first contacting surface, a second surface, a guiding surface and a rib being adjacent to the recess portion;

the actuator removeably inserted in the receiving space and having a driving surface engageable with the bottom surface of the flexible printed circuit board, and an actuating surface facing the biasing beam;

wherein the actuating surface is arranged with a plurality of first and second steps arranged in line, when the first step engages with the biasing beam, the conductive traces are substantially distant with respect to the contact engaging terminals, and when the second step engages with the biasing beam, the conductive traces are electrically engaged with the contact engaging terminals;

the end wall defines a recess which forms a guiding slot cooperating with the metallic ear for respectively receiving a pair of latches of the slider; a pair of metallic ears, each having a body portion covering on the recess of the end wall, a retaining nail extending from one side of the body portion and retained in the end wall, a solder tail extending from another side of the body portion and coplanar with the soldering portion of the terminal and a fixing portion at rear end thereof for preventing the metallic ear moving forward.

18. The interconnecting system as described in claim 17, wherein said actuator is moved in a vertical direction correspondingly when the actuator is moved between an open position where the first step engages with the biasing beam, and a closed position where the second step engages with the biasing beam, in a front-to-back direction.

19. The interconnecting system as described in claim 17, wherein the first and second steps are separated from each other.

20. The interconnecting system as described in claim 19, wherein the actuator comprises the guiding surface linking the first and second steps together.

* * * * *